US008047403B2

(12) United States Patent
Quinlan et al.

(10) Patent No.: US 8,047,403 B2
(45) Date of Patent: Nov. 1, 2011

(54) BIFURCATED STEM FOAM PUMP

(75) Inventors: Robert L. Quinlan, Stow, OH (US); Mark E. Rosenkranz, Medina, OH (US); Aaron R. Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 678 days.

(21) Appl. No.: 12/069,214

(22) Filed: Feb. 8, 2008

(65) Prior Publication Data

US 2009/0200337 A1 Aug. 13, 2009

(51) Int. Cl.
*A47K 5/14* (2006.01)

(52) U.S. Cl. ..... 222/190; 222/321.9

(58) Field of Classification Search ..... 222/190, 222/321.7, 321.9
See application file for complete search history.

(56) References Cited

U.S. PATENT DOCUMENTS

| | | | | |
|---|---|---|---|---|
| 4,880,161 | A | 11/1989 | Wright | |
| 4,957,218 | A | 9/1990 | Ford, Jr. | |
| 5,222,633 | A | 6/1993 | Blake | |
| 5,372,281 | A | 12/1994 | Palmer et al. | |
| 5,411,177 | A | 5/1995 | Blake, III | |
| 5,445,288 | A | 8/1995 | Banks | |
| 5,752,627 | A * | 5/1998 | Vandromme et al. | 222/321.7 |
| 5,779,104 | A * | 7/1998 | Reidel | 222/190 |
| 5,984,146 | A | 11/1999 | Kaufman | |
| 6,612,468 | B2 * | 9/2003 | Pritchett et al. | 222/190 |
| 2005/0072805 | A1 | 4/2005 | Matthews | |
| 2006/0273114 | A1 | 12/2006 | Ophardt | |
| 2007/0023454 | A1 | 2/2007 | Ophardt | |
| 2008/0083783 | A1 * | 4/2008 | Nelson | 222/190 |
| 2008/0083784 | A1 * | 4/2008 | Foster et al. | 222/190 |
| 2009/0184137 | A1 | 7/2009 | O'Brien | |

FOREIGN PATENT DOCUMENTS

| | | |
|---|---|---|
| WO | 99/49769 | 10/1999 |

OTHER PUBLICATIONS

International Search Report and the Written Opinion from International application No. PCT/US2009/000725, date of mailing May 11, 2009; 12 pages.

* cited by examiner

*Primary Examiner* — Kenneth Bomberg
(74) *Attorney, Agent, or Firm* — Calfee, Halter & Griswold LLP

(57) ABSTRACT

A bifurcated stem foam pump for use in foam dispensers. An air compressor portion of the bifurcated pump is attached to and maintained as a portion of the dispenser housing. A portion of the pump for transferring liquid and including a portion for generating foam is attached to and provided as a portion of a replaceable liquid-containing cartridge in the foam dispenser. The two portions mate and form a completed pump assembly operative for generating foam from the liquid of the cartridge when the cartridge is placed within the dispenser housing and the two pump portions are mated. The air compressor portion includes a collar having an air piston reciprocatingly received therein. The collar is attached to the dispenser housing. A collar receiving a hollow stem pump is attached to the liquid cartridge. Actuation of the air piston correspondingly actuates the stem pump such that air and liquid are forced together in the stem pump and through a foam generating member.

20 Claims, 1 Drawing Sheet

BIFURCATED STEM FOAM PUMP

TECHNICAL FIELD

The invention herein resides in the art of liquid dispensing mechanisms and, more particularly, to those mechanisms that are particularly adapted for dispensing a liquid in the form of a foam. Specifically, the invention relates to the foam pump generator for such dispensers, and particularly one that is bifurcated or separated between the liquid pump portion and the air pump portion. Specifically the invention relates to a foam pump that allows the liquid pump portion to be fixed to and a part of the disposable refill cartridge containing the liquid, and in which the air pump or compressor is a non-disposable portion of the dispenser housing.

BACKGROUND OF THE INVENTION

For many years, it has been known to dispense liquids, such as soaps, sanitizers, cleansers, disinfectants, and the like from a dispenser housing maintaining a removable and replaceable cartridge containing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid, generating the formation of bubbles thereby. Accordingly, the standard liquid pump has given way to a foam generating pump, which necessarily requires means for combining the air and liquid in such a manner as to generate the desired foam. However, foam generating pumps are more expensive than liquid dispensing pumps, necessarily increasing the cost of disposable cartridges that include the pump with each cartridge.

Typically, foam pumps include an air compressor portion and a fluid passing portion—the two requiring communication to ultimately create the foam. The portion required for compressing the air is not given to wear and degradation to the extent of the portion required for passing the liquid and generating the foam from the combination of liquid and air. Accordingly, it has been determined that there is no necessity for replacing the air compressor, but only the liquid pumping and foam generating portion of the pump when replacement of the cartridge is necessary. Accordingly, a bifurcation of the pump has been determined to be possible and desirable.

DISCLOSURE OF THE INVENTION

In light of the foregoing, it is a first aspect of the invention to provide a foam pump generator in which the air compression portion is separate and distinct from the liquid passing and foam generating portion.

Another aspect of the invention is the provision of a bifurcated foam pump generator in which the liquid passing and foam generating portion is disposable and replaceable with a liquid cartridge, while the air generator is substantially fixed to the dispenser housing.

Yet another aspect of the invention is the provision of a bifurcated foam pump generator that is cost effective in implementation and capable of producing high quality foam in operation.

Still a further aspect of the invention is the provision of a bifurcated foam pump generator that is readily constructed from state of the art devices and structures, and that is conducive to implementation with presently existing dispensers.

Still a further aspect of the invention is the provision of a bifurcated foam pump generator, having a portion thereof fixed to a housing of a dispenser and the remaining portion thereof being a part of a replaceable cartridge, and in which the joinder of the parts is easily effected in the field during cartridge replacement.

The foregoing and other aspects of the invention that will become apparent as the detailed description proceeds are achieved by the improvement of a bifurcated foam pump assembly in a foam dispenser having a housing and an actuator, and receiving a liquid cartridge, the improvement comprising: a foam dispenser having a dispenser housing and an actuator, and receiving a liquid cartridge, the improvement of a bifurcated foam pump assembly, comprising: an air compressor portion attached to the dispenser housing; and a liquid pump portion connected to the liquid cartridge, said liquid pump portion separably mating with said air compressor portion.

Other aspects of the invention which will become apparent herein are achieved by a liquid container for a foam generating dispenser, comprising: a cartridge defining a volume for receiving a liquid; a collar sealingly attached to said cartridge; a pump shaft received by said collar, said pump shaft having an annular seal extending circumferentially thereabout, said annular seal being adapted for engagement with a wall of a collar maintained in the housing of a dispenser; and a foam generating element at an end of said pump shaft.

BRIEF DESCRIPTION OF DRAWINGS

For a complete understanding of the aspects, structures and techniques of the invention, reference should be made to the following detailed description and accompanying drawings wherein.

BEST MODE FOR CARRYING OUT THE INVENTION

Figure 1:
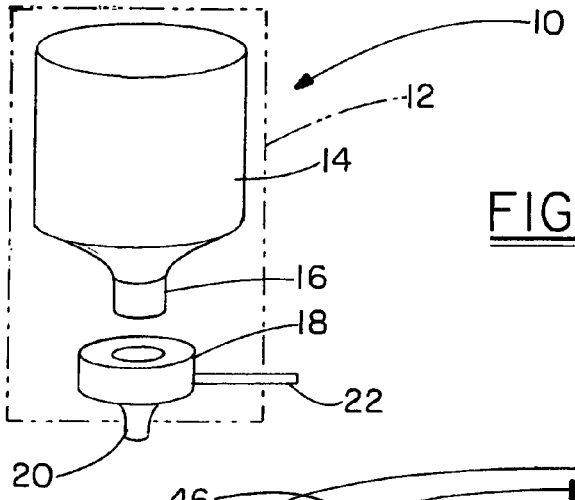
FIG. 1 is an illustrative functional view of a bifurcated stem foam pump made in accordance with the invention.

Referring now to the drawings and more particularly FIG. 1, it can be seen that a foam solution dispenser employing the bifurcated foam pump assembly of the invention is designated generally by the numeral 10. It will be appreciated that the foam solution dispenser may be of any of various types, adapted for dispensing soap, lotion, sanitizers, cleaners or the like in the form of a foam. The dispenser 10 includes a housing 12, typically of molded plastic or the like. The housing 12 defines a cavity which is adapted to receive a bottle or cartridge 14 of liquid of the particular type required for generating the desired foam. The bottle or cartridge 14 is nestingly received by the housing 10 and, as will be readily appreciated by those skilled in the art, is received and contained by supporting brackets, collars and the like within the housing 12.

A liquid pump 16 is connected to and provided as a portion of the disposable refill cartridge or bottle 14. In contradistinction, an air compressor unit 18 is provided as part and parcel of the dispenser housing 12. In the preferred embodiment of the invention, the air compressor 18 includes a dispensing nozzle 20, through which the generated foam is dispensed onto the hand of the user, utensil, or otherwise.

A suitable actuator 22 is operatively connected to the air compressor 18 to achieve actuation of the foam generator comprising the combination of the liquid pump 16 and air compressor 18. Those skilled in the art will understand that foam is typically generated from a combination of air and liquid, with the two being forced together, agitated, stirred, forcefully blended, or the like. The actuator 22 may be either manually actuated as in the case of a lever, push bar, or the like; or it may be electronically or optically actuated as in the implementation of touch free dispensers.

It will be appreciated that a concept of the invention, and as particularly presented below, is the implementation and utilization of a bifurcated foam pump assembly, in which the liquid pump portion is attached to and made a portion of the disposable and replaceable cartridge 14, containing the liquid ingredient of the foam solution, while the air compressor 18 and associated nozzle 20 are not disposable, but remain a portion of the dispenser housing 12.

Figure 2:
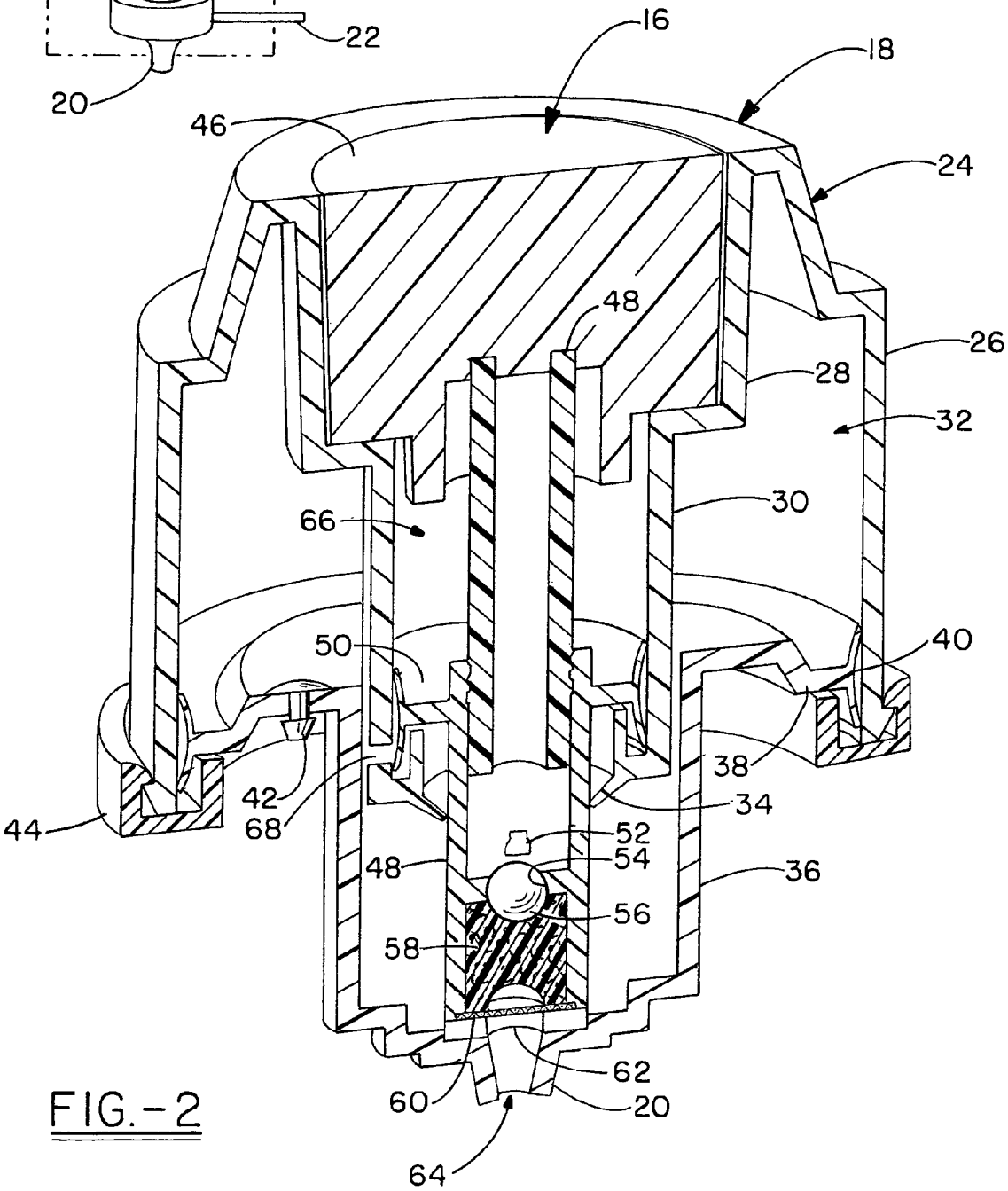
FIG. 2 is a cross sectional view of the bifurcated stem foam pump of the invention.

With reference now to FIG. 2, an appreciation can be obtained regarding the specific structure and interrelationships of the liquid pump 16 and the air compressor 18 embodied in the bifurcated pump of the invention. Specifically, with regard to the air compressor 18 and nozzle 20, which constitute a fixed permanent part of the housing 12 of the dispenser 10, it will be appreciated that a primary portion thereof is an annular collar 24. The collar 24 consists of an outer ring 26 interconnected with an inner ring formed from a first inner wall 28 interconnected with a second inner wall 30. As shown, an annular cavity 32 is defined between the outer ring 26 and the inner ring comprised of the first and second inner walls 28, 30. The cavity 32 establishes the air chamber which is employed as a portion of the air compressor of the invention. A seal ring 34 extends from a bottom portion of the second inner wall 30 and defines an annulus that receives the stem of the liquid pump of the invention and serves as a seal as the piston thereof moves to effect dispensing, as will be discussed below.

An air piston 36 is received by the outer ring 26 and is reciprocatingly movable within the cavity 32 to effect operation of the air compressor. The air piston 36 includes a top annular disk 38 having a circumferential seal 40 extending thereabout. The seal 40 engages the inner wall surface of the outer ring 26, as shown. A one way check valve or button valve 42 is provided within an aperture of the top annular disk 38 to allow air to enter the cavity or air chamber 32 during operation and as will become apparent below.

It will be appreciated that a spring (not shown) may be maintained within the cavity 32 and interposed between the top annular disk 38 and the annular collar 24 to bias the two away from each other toward a position maximizing the volume of the cavity of the air chamber 32. The invention contemplates either an interior spring, exterior spring, or other type of biasing structure, readily perceivable by those skilled in the art, for implementation with the invention.

The annular collar 24 is received by a mounting ring 44 which is part and parcel of the dispenser housing 12. Similarly, the mounting ring 44 provides a stop for the top annular disk 38 during operation. As presented above, the air compressor and nozzle 18, 20 is contemplated to be a fixed permanent portion of the dispenser housing and, to the extent there received and maintained by the mounting ring 44, and comprise a portion of the dispenser housing.

The present invention contemplates the liquid pump is of a conventional stem-type pump, frequently used in the dispensing of various fluids. In accordance with the invention, the liquid pump 16 includes a reservoir collar 46 received by the annular collar 24 and connected to the disposable and replaceable cartridge 14 and forming therewith liquid reservoir 66. The reservoir collar 46 receives a hollow valve stem 48 that extends from the reservoir collar 46 downwardly to the nozzle 20, when the pump 16 is placed into the air compressor 18. A sealing flange 50 extends radially outwardly from the hollow valve stem 48 (pump shaft) and makes sealing engagement with the inner surface of the second wall 30, as shown. As illustrated, the interior of the second wall 30 defines an extension of the liquid reservoir cavity defined by the reservoir collar 46. Of course, as will be appreciated by those skilled in the art, the sealing flange 50 moves axially within the liquid reservoir cavity with the valve stem 48 to reduce the volume of the cavity, thus forcing liquid within the cavity through the hollow valve stem in a customary manner.

The hollow valve stem 48 includes a check valve in an aperture passing therethrough as indicated at 52. Further, the valve stem 48 includes an inner extending annular ring forming a valve seat 54, as shown. A ball valve 56 is in operative engagement with the valve seat 54 and biased thereagainst by means of a sponge, screen, mesh or the like 58. The element 58 serves to assist in the generation of foam by receiving and passing liquid and air therethrough. In any event, it is preferred that the element 58 be resilient, serving as both a foam generating member and a valve biasing member, urging the ball valve 56 into sealing engagement with the valve seat 54.

A final screen 60 extends across an outlet aperture 62 at the end of the hollow valve stem 48, as shown. An outlet passage 64 extends axially from the nozzle 20. As illustrated, an air aperture 68 passes through the second wall 30 of the inner ring defining the air chamber 32.

It will be appreciated that the liquid pump 16, comprising primarily the elements 46-66 just described, is part and parcel of the disposable cartridge 14, filled with appropriate liquid or the like. The liquid pump assembly 16 is inserted into and received by the air compressor 18, which is a fixed portion of the dispenser housing 12. Of course, appropriate seals are provided on the pump 16 and/or compressor 18 to effect this mating engagement.

In operation, the air chamber or cavity 32 is filled with air and the hollow stem valve 48 and associated liquid reservoir 66, in communication with the interior of the cartridge 14, is filled with appropriate liquid. When the actuator 22 is engaged, the air piston 36 is driven upwardly into the air chamber 32, compressing the air therein and urging it through the aperture 68 and into the area surrounding the valve stem 48 as it moves upwardly within the sealing ring 34. With this upward movement, the liquid within the container 14 and reservoir 66 is driven through the hollow stem valve 48 downwardly against the ball valve 56, unseating it from the seat 54. The check valve 52 prevents the liquid from otherwise escaping from the hollow stem 48.

When the check valve 52 travels beyond the seal ring 34, the compressed air from the air chamber 32 passes through the check valve 52 and into the hollow valve stem 48, further driving the ball valve 56 from the seat 54 and into the sponge, screen, mesh or the like 58. Accordingly, with continued movement of the piston 36, liquid and air are driven past the ball valve 56 and through the element 58 by which the air and liquid are sufficiently mixed to form a foam that is extruded through the screen 62 and out the passage 64 of the nozzle 20.

At the end of the dispensing stroke, as determined by the actuator 22 or otherwise, an appropriate biasing member urges return of the air piston 36. Upon such urging, the one way check valve or button valve 42 opens, allowing air to return into the air chamber 32. Similarly, the element 58 urges the ball valve 56 into engagement with the valve seat 54 to preclude any further passage of liquid to the element 58. With the hollow valve stem 48 urged by a spring or other biasing member toward the air piston 36, the hollow valve stem 48 is repositioned for the next dispensing cycle.

Thus it can be appreciated that the aspects of the invention have been achieved by the structure presented above. The fluid pump of the invention can be a commonly available fluid pump requiring minimal if any modification. The fluid pump is fixedly attached to and remains a portion of the disposable liquid cartridge 14. Since the liquid pump is primarily in gravity-effected nesting engagement with the air compressor 18, removal and replacement of the cartridge 14 is easily achieved. Moreover, the liquid pump can be manufactured of inexpensive materials, with the only requirement that it perform satisfactorily for the number of dispensing cycles required to deplete the cartridge 14. On the other hand, the air compressor portion of the invention, is an integral and permanent portion of the dispenser housing, and is capable of repeated use through numerous refills and replacements of the cartridge 14.

While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A foam dispenser comprising:

a dispenser housing;

the dispenser housing having an actuator and an air compressor portion attached to the dispenser housing; and a liquid pump portion connected to a liquid cartridge, said liquid pump portion configured to be selectively mated with said air compressor portion, wherein the liquid pump portion and liquid cartridge are disposable after the liquid is pumped out of the liquid cartridge, while the air compressor portion remains attached to the dispenser housing.

2. The foam dispenser according to claim 1, wherein said air compressor comprises an annular collar received by the housing and an air piston received by said collar, said collar and air piston defining an air chamber therebetween.

3. The foam dispenser according to claim 2, wherein said liquid pump comprises a pump shaft at least partially maintained within a reservoir collar, said pump shaft and reservoir collar being adapted for receipt by said annular collar and said air piston.

4. The foam dispenser according to claim 3, wherein said liquid pump further comprises a sealing flange about said pump shaft and in moveable sealing engagement with an interior surface of said annular collar.

5. The foam dispenser according to claim 4, wherein said annular collar further comprises a ring seal circumferentially engaging said pump shaft.

6. The foam dispenser according to claim 5, wherein said pump shaft is hollow and further comprises an aperture passing through a wall thereof, movement of said piston selectively positioning said aperture with respect to said ring seal to selectively interconnect said air chamber and an interior of said hollow shaft.

7. The foam dispenser according to claim 6, wherein said hollow shaft further comprises a ball valve and seat.

8. The a foam dispenser according to claim 7, wherein said hollow shaft receives a foam generating member at an end thereof in juxtaposition to an outlet nozzle at an end of said air piston.

9. The foam dispenser according to claim 8, wherein said ball valve is urged against said seat by said foam generating member.

10. The foam dispenser according to claim 9, wherein said foam generating member is a resilient member selected from the group of a sponge, screen, mesh and close cell foam.

11. A liquid container for a foam generating dispenser, comprising:

a cartridge defining a volume for receiving a liquid;

a first collar sealingly attached to said cartridge;

a pump shaft received by said first collar, said pump shaft having an annular seal extending circumferentially around the outside of said pump shaft, said annular seal being adapted for engagement with a wall of a second collar maintained in the housing of a dispenser; and a foam generating element at an end of said pump shaft.

12. The liquid container for a foam generating dispenser according to claim 11, wherein said pump shaft is hollow and has an aperture passing through a wall thereof.

13. The liquid container for a foam generating dispenser according to claim 12, wherein said pump shaft further comprises a ball valve and seat therein.

14. The liquid container for a foam generating dispenser according to claim 13, wherein said foam generating member biases said ball valve against said seat.

15. The liquid container for a foam generating dispenser according to claim 14, wherein said aperture is in juxtaposition to said ball valve.

16. The liquid container for a foam generating dispenser according to claim 15, wherein said foam generating element is resilient, and selected from the group of sponge, close cell foam, screen and mesh.

17. The liquid container for a foam generating dispenser according to claim 13, which is devoid of an air chamber.

18. A refill unit for a foam dispenser comprising:

a liquid pump portion connected to a liquid cartridge, a foam generating element attached to the liquid pump portion, the liquid pump portion configured to be selectively mated with an air compressor portion that is attached to a foam dispenser, wherein the liquid pump portion and liquid cartridge are disposable after the liquid is pumped out of the liquid cartridge, without disposing of the air compressor portion that remains secured to the dispenser housing.

19. The refill unit for a foam dispenser of claim 18 further comprising:

a hollow pump shaft, an aperture located in the hollow pump shaft, a check valve located proximate the aperture to allow air to flow into the hollow pump shaft but prevents air or liquid from flowing out of the hollow pump shaft through the aperture;

wherein the aperture is located upstream of a check valve that is resiliently biased in a closed position, but allows fluid and air under pressure to pass there through.

20. The refill unit for a foam dispenser of claim 18 further comprising a seal located between the liquid pump and a wall of the air compressor portion to prevent air or liquid from moving past the seal.

* * * * *